US008006879B2

(12) United States Patent
Uchiyama et al.

(10) Patent No.: US 8,006,879 B2
(45) Date of Patent: Aug. 30, 2011

(54) GAS COMBUSTION TYPE DRIVING TOOL

(75) Inventors: Toru Uchiyama, Tokyo (JP); Keijiro Murayama, Tokyo (JP)

(73) Assignee: Max Co., Ltd., Tokyo (JP)

( * ) Notice: Subject to any disclaimer, the term of this patent is extended or adjusted under 35 U.S.C. 154(b) by 105 days.

(21) Appl. No.: 12/438,076

(22) PCT Filed: Aug. 13, 2007

(86) PCT No.: PCT/JP2007/065807

§ 371 (c)(1),
(2), (4) Date: Feb. 19, 2009

(87) PCT Pub. No.: WO2008/023589

PCT Pub. Date: Feb. 28, 2008

(65) Prior Publication Data

US 2010/0170930 A1 Jul. 8, 2010

(30) Foreign Application Priority Data

Aug. 22, 2006 (JP) ..... 2006-225632

(51) Int. Cl.
*B25C 1/08* (2006.01)
*H01T 13/54* (2006.01)

(52) U.S. Cl. .... 227/10; 227/129; 123/46 SC; 123/169 R

(58) Field of Classification Search ..... 227/9, 10, 227/119, 120, 129, 130, 138; 123/46 R, 123/46 SC, 169 R
See application file for complete search history.

(56) References Cited

U.S. PATENT DOCUMENTS

| | | | | | |
|---|---|---|---|---|---|
| 2,894,161 | A | * | 7/1959 | Sheheen | 313/131 R |
| 3,748,770 | A | * | 7/1973 | Mitchell | 42/84 |
| 3,980,059 | A | * | 9/1976 | Noguchi et al. | 123/262 |
| 4,774,914 | A | * | 10/1988 | Ward | 123/162 |
| 4,841,925 | A | * | 6/1989 | Ward | 123/143 B |
| 5,211,142 | A | * | 5/1993 | Matthews et al. | 123/143 B |
| 5,619,959 | A | * | 4/1997 | Tozzi | 123/143 B |
| 5,947,076 | A | * | 9/1999 | Srinivasan et al. | 123/267 |

(Continued)

FOREIGN PATENT DOCUMENTS

CN 2186459 Y 12/1994

(Continued)

*Primary Examiner* — Paul R Durand
(74) *Attorney, Agent, or Firm* — Drinker Biddle & Reath LLP

(57) ABSTRACT

A driving piston 4 is provided slidably up and down in a driving cylinder 3 arranged in a tool body 1. By moving a movable sleeve 10 provided at the upper portion of the driving cylinder 3 up and down, the movable sleeve 10 is brought into contact with and separated from the driving cylinder 3 and a cylinder head 8 provided above the driving cylinder 3, whereby a combustion chamber can be opened and closed. Mixture gas obtained by stirring and mixing combustible gas and air together in the combustion chamber by a fan 16 is ignited by an ignition plug 15 disposed at the cylinder head 8 and explosively combusted. By this high-pressure combustion gas, the driving piston 4 is impulsively driven, and a driver 5 coupled to the lower surface side of the driving piston drives nails. Between an exposed base portion of a center electrode of the ignition plug 15 which is exposed to the outside facedown and a leading end of the center electrode, there is provided a stagnation part 25 which stagnates temporarily a residue remaining after the combustion of the mixture gas.

7 Claims, 8 Drawing Sheets

U.S. PATENT DOCUMENTS

| | | | | |
|---|---|---|---|---|
| 6,257,476 | B1 * | 7/2001 | Ehmig | 227/10 |
| 6,321,733 | B1 * | 11/2001 | Suckewer et al. | 123/620 |
| 7,014,086 | B2 * | 3/2006 | Dittrich et al. | 227/9 |
| 2005/0173485 | A1 * | 8/2005 | Moeller et al. | 227/10 |
| 2006/0102111 | A1 * | 5/2006 | Ohmori et al. | 123/46 H |
| 2007/0006843 | A1 | 1/2007 | Gansert et al. | |
| 2010/0170930 | A1 * | 7/2010 | Uchiyama et al. | 227/9 |

FOREIGN PATENT DOCUMENTS

| | | |
|---|---|---|
| JP | 4-48589 | 8/1992 |
| JP | 5-99109 | 4/1993 |
| JP | 2003-176773 | 6/2003 |
| JP | 2005-046977 | 2/2005 |
| JP | 2005-138231 | 6/2005 |
| WO | WO 2005/008039 | 1/2005 |

* cited by examiner

GAS COMBUSTION TYPE DRIVING TOOL

TECHNICAL FIELD

The present invention relates to a gas combustion type driving tool in which power is supplied by combustion thereby to drive fasteners such as nails or the like, and particularly to a gas combustion type driving tool which is improved so that stain of a leading end of a center electrode of an ignition plug with a residue of combustion gas is delayed.

BACKGROUND ART

In a gas combustion type driving tool, as indicated in Patent Document 1, mixture gas obtained by stirring and mixing combustible gas and air together in a combustion chamber by a fan is ignited by sparks from an ignition plug and explosively combusted, and a driving piston is driven by gas pressure of this combustion gas to drive fasteners such as nails, screws, or the like. In such the gas combustion type driving tool, a combustion residue from additives of the combustion gas supplied in the combustion chamber can adhere to a center electrode of the ignition plug. The combustion residue adhering to the center electrode of the ignition plug accumulates gradually on the leading end of the center electrode, which becomes a large cause to invite poor ignition of the ignition plug.

In the gas combustion driving tool, in order to return surely the driving piston after driving the fasteners to the initial position, increase in quantity over the most suitable quantity of gas density is performed. Hereby, even in the usual combustion time, the many are produced. The residue adheres to a wall portion of the combustion chamber, the ignition plug, and the like. In particular, an attachment position of the ignition plug in the combustion chamber is a position at which the wind of a stirring fan is difficult to arrive. Therefore, the residue is easy to adhere to the ignition plug. The ignition plug is disposed facedown at the upper portion of the combustion chamber, and further the residue adhering to the center electrode of the ignition plug is comparatively high in viscosity. Therefore, while the combustion is repeated many times, the residue flows down along the outer surface of the center electrode little by little and arrives at the leading end of the center electrode. The residue which has arrived at the leading end, without dropping, stays at the leading end for a while. Since a residue which flow down sequentially from the upside stick to the residue which has stayed at the leading end, the residue grows gradually. In result, the poor ignition is caused.

In order to solve the above-mentioned disadvantage, an improved ignition plug has been disclosed in Patent Document 2. In an ignition plug in the Patent Document 2, a free end of a spark unit electrode (electrode of the ignition plug), that is, a spark ejected leading end portion (electrode leading end portion which ejects sparks) protrudes positively to the outside from the lower surface of a boss to which the spark unit electrode is attached. Hereby, the improvement is made so that a recess portion or a pocket portion is not formed around the free end of the electrode, whereby oil or dust is not accumulated around the free end of the electrode, with the result that the electrode is protected and trouble such as the poor ignition is prevented.

Patent Document 1: JP-B-04-048589

Patent Document 2: JP-A-2003-176773

However, the countermeasure for protecting the electrode in the above Patent Document 1 is taken for protection of the electrode from the oil or dust accumulated in the recess portion or the pocket portion, and there is particularly no electrode protecting countermeasure from a view of preventing a residue from adhering to the protruded electrode leading end portion. By such the known electrode protecting countermeasure, it is not possible at all to solve the occurrence of trouble such as poor ignition due to adhesion of the residue to the ignition plug in the gas combustion type driving tool under the above circumstances.

DISCLOSURE OF THE INVENTION

One or more embodiments of the invention provide a gas combustion type driving tool in which, by giving structural improvement to an electrode of an ignition plug, accumulation of the above residue on a center electrode leading end portion of the plug is delayed, whereby a maintenance work of the ignition plug is reduced.

According to a first aspect of the invention, in a gas combustion type driving tool, a driving piston is provided slidably in the up-down direction for a driving cylinder disposed in a tool body. A movable sleeve provided for the upper part of the driving cylinder is moved up and down, and brought into contact with and separated from the driving cylinder and a cylinder head provided above the driving cylinder, whereby a combustion chamber can be opened and closed. Mixture gas obtained by stirring and mixing combustible gas and air together in a combustion chamber by a fan is ignited by an ignition plug disposed at the cylinder head and explosively combusted. This high-pressure combustion gas is applied to the driving piston to drive impulsively the driving piston, whereby a driver coupled to the lower surface side of the driving piston drives nails. A stagnation part for stagnating temporarily a residue remaining after the combustion of the mixture gas is provided between an exposed base portion of a center electrode of the ignition plug which is exposed to the outside facedown and a leading end of the center electrode.

According to a second aspect of the invention, the stagnation part may be an annular step part.

According to a third aspect of the invention, the stagnation part may be an annular protrusion.

According to a fourth aspect of the invention, the annular protrusion may be formed by a ring fitted and fixed to the center electrode.

According to the first aspect, the stagnation part for stagnating temporarily the residue produced by the combustion of the mixture gas is provided between the exposed base portion of the center electrode of the ignition plug which is exposed to the outside facedown and the leading end of the center electrode. Therefore, though the residue flows gradually downward along the center electrode, the residue stops at the stagnation part so as to stagnate once by their surface tension. In result, the arrival of the residue at the leading end of the center electrode is delayed. Accordingly, stain of the leading end of the center electrode is delayed, with the result that the life of the ignition plug is extended. Further, in case that maintenance check of the ignition plug is performed, the number of the maintenance checks can be greatly reduced.

According to the second aspect, since the stagnation is the annular step part, the residue stagnates on the lower surface of the step part. Further, the annular step part can be easily formed by machining. Further, in case that this step part is formed in a multistep way, the stagnation advantage and the stain-delay advantage become higher.

According to the third aspect, since the stagnation part is the annular protrusion, the residue stagnates on the lower and upper surfaces of the annular protrusion. Further, in case that this annular protrusion is formed in a multistep way, the stagnation advantage becomes higher.

According to the fourth aspect, since the annular protrusion is formed by the ring fitted and fixed to the center electrode, the annular protrusion can be easily formed without directly machining the center electrode. Further, the exchange of the ring makes the removal work of the residue unnecessary.

Other aspects and advantages of the invention will be apparent from the following description, the drawings and the claims.

DESCRIPTION OF REFERENCE NUMERALS AND SIGNS

1 Tool body
3 Driving cylinder
6 Combustion chamber
15 Ignition plug
25 Step part (stagnating part)

BEST MODE FOR CARRYING OUT THE INVENTION

Figure 1:
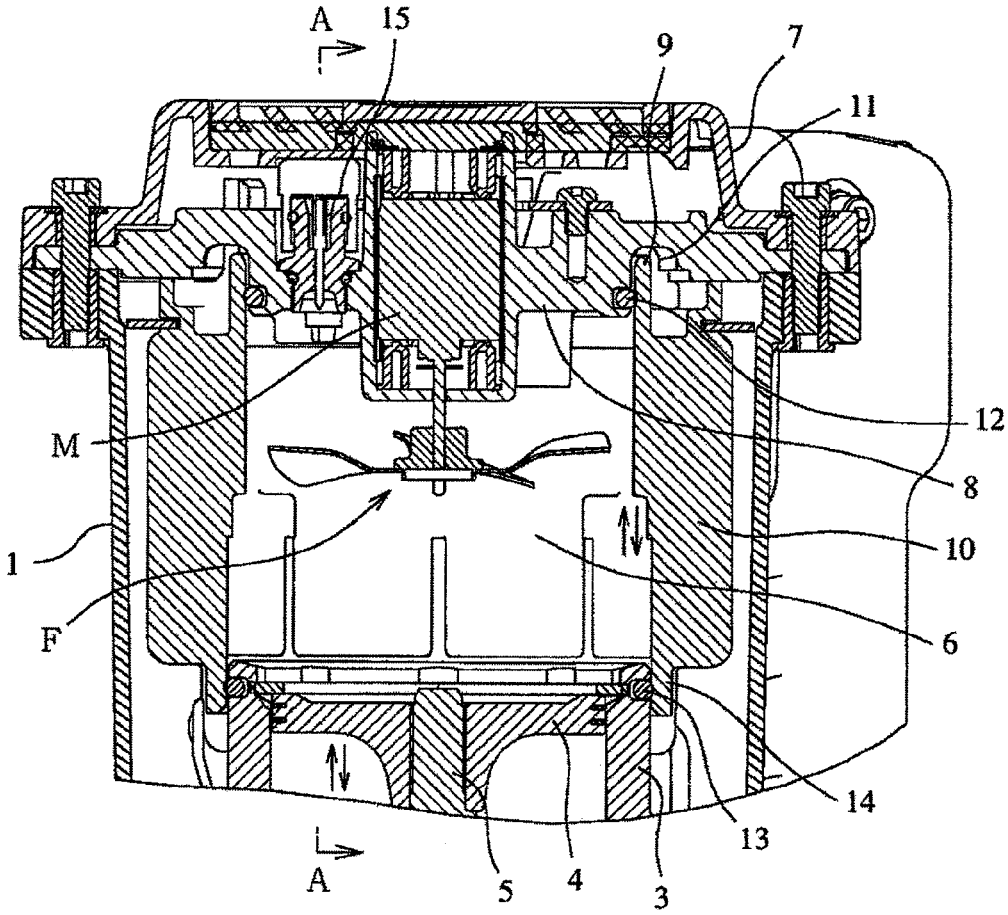
FIG. 1 is a longitudinal cross sectional view showing a main structure part of a gas nailer provided with an ignition plug in the invention.
Figure 2:
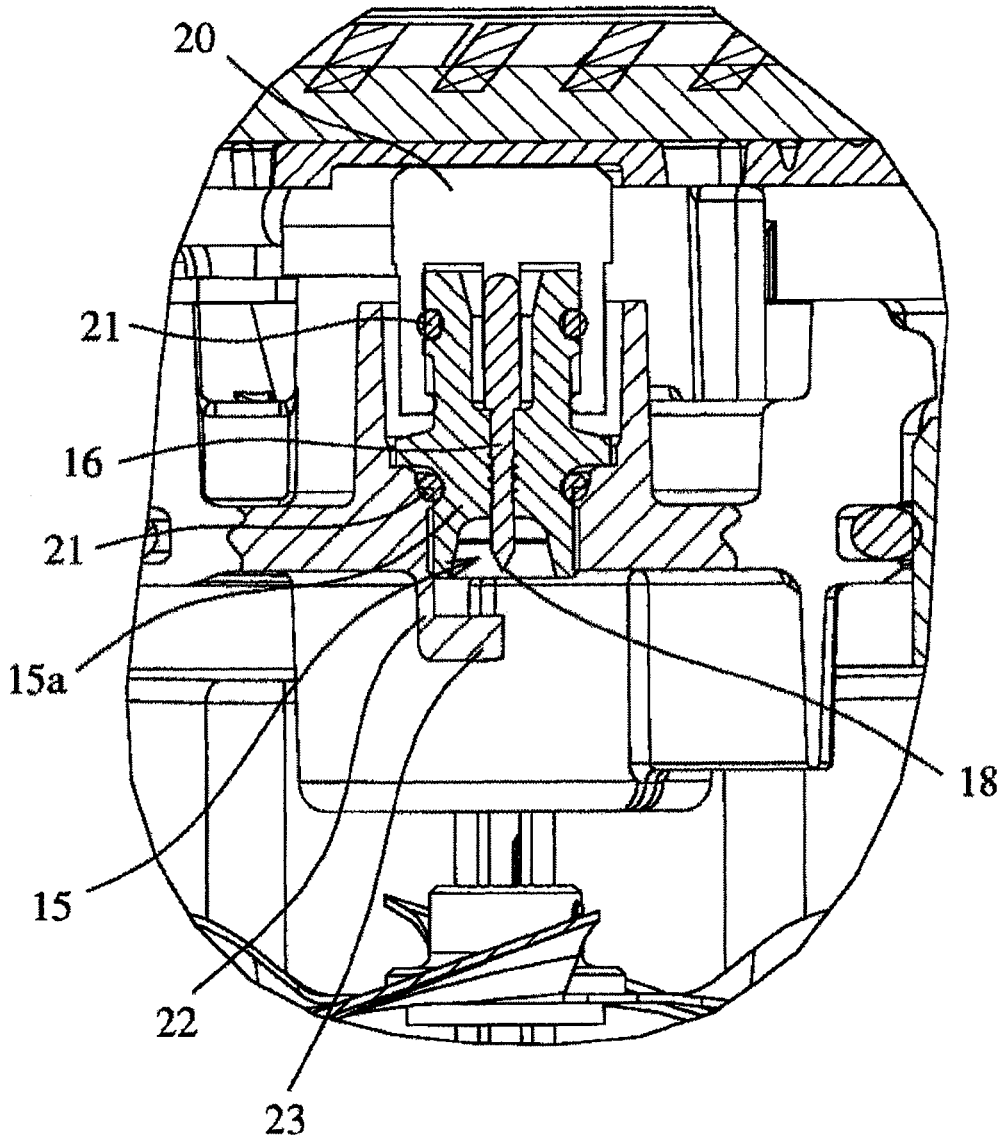
FIG. 2 is a main portion enlarged longitudinal cross sectional view taken along a line A-A of FIG. 1.

In FIGS. 1 and 2, reference numeral 1 denotes a tool body of a nailer as an example of a gas combustion type driving tool. At this tool body 1, a grip, which is not shown, is consecutively installed similarly to in the usual gas combustion type nailer. Below the tool body 1, a nose part for driving a nail and a magazine for supplying the nail into the nose are provided. Further, inside the tool body 1, a driving piston/cylinder mechanism is provided.

In the driving piston/cylinder mechanism, a driving piston 4 is slidably accommodated in a driving cylinder 3, and a driver 5 is integrally coupled to the lower portion of the driving piston 4.

Next, over the driving cylinder 3, a combustion chamber 6 is constituted in an openable and closable way. The combustion chamber 6 is formed by an upper end surface of the driving piston 4, and a movable sleeve 10 arranged between a the driving cylinder 3 and a cylinder head 8 formed inside an upper housing 7 movably up and down.

Namely, in the bottom surface of the cylinder head 8, a reception groove 11 that receives an upper end of the movable sleeve 10 is formed, and a seal part 12 is provided on an inner surface inside this reception groove 11. Similarly, also on an outer surface of an upper end of the driving cylinder 3, a seal part 13 is provided.

The movable sleeve 10 is formed cylindrically, and an inner wall of its upper end protrudes inward thereby to form a protrusion wall 9. This protrusion wall 9 is formed so that its inner surface can abut on the upper seal part 12 of the cylinder head 8. Further, the movable sleeve 10 is arranged so that the inner surface of a lower end 14 thereof can abut on the lower seal part 13 located at the upper end of the driving cylinder 3.

In the cylinder head 8, there are arranged an ejection nozzle (not shown) communicating with a gas container, and an ignition plug 15 for igniting and combusting mixture gas. Further, in the upper housing 7, there is provided a rotary fan F which stirs together combustible gas ejected into the combustion chamber 6 and air in the combustion chamber 6 thereby to generate mixture gas having the predetermined air-fuel ratio in the combustion chamber 6. A character M denotes a fan motor.

In the above combustion chamber structure, regarding the nail driving, first, a not-shown contact arm is pushed strongly on the workpiece, and simultaneously the movable sleeve 10 is moved upward till the sleeve 10 enters into the reception groove 11 of the cylinder head 8 as shown in FIG. 1. By the upward movement of the movable sleeve 10, the movable sleeve 10 abuts on the upper seal part 12 provided for the cylinder head 8 and the lower seal part 13 provided for the driving cylinder 3, whereby the combustion chamber 6 hermetically sealed is formed. Into this combustion chamber 6, the combustible gas is ejected from the ejection nozzle, and the rotary fun F is rotated to stir and mix the combustible gas and the air together. When a trigger is pulled and the mixture air is ignited with the ignition plug 15, the mixture gas is explosively combusted. Hereby, the driving piston 4 is driven and moves down to drive a nail into the workpiece.

After the nail driving, the gas in the combustion chamber 6 is cooled and the combustion chamber 6 becomes a negative pressure state. Therefore, the driving piston 4 moves up and returns to the initial position. When the trigger is released, the movable sleeve 10 moves down, whereby the upper and lower ends of the movable sleeve 10 separate respectively from the seal part 12 of the cylinder head 8 and the upper seal part 13 of the driving cylinder 3. In result, an air inlet is formed at the upper portion of the combustion chamber 6, and an exhaust outlet is formed at the lower portion thereof. Then, the next nail driving operation is prepared.

Figure 3:
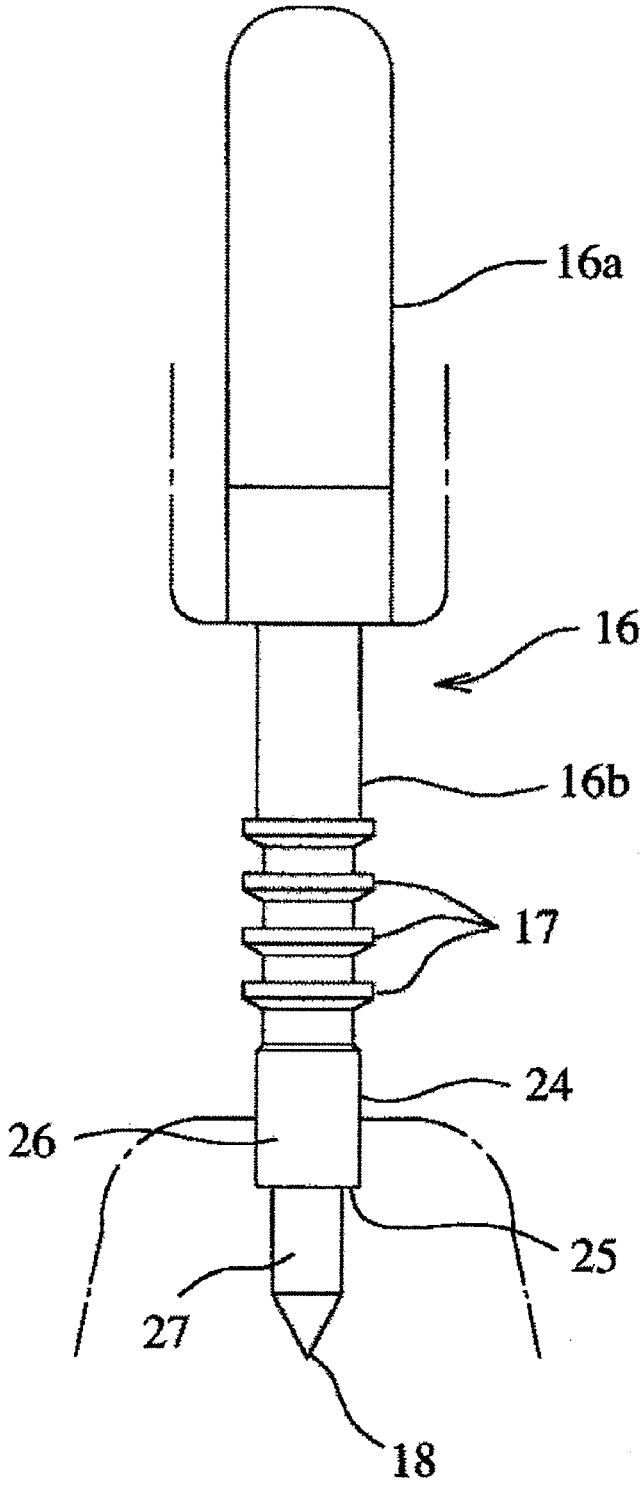
FIG. 3 is a side view of a center electrode of an ignition plug in an embodiment of the invention.

The ignition plug 15, as shown in FIGS. 2 and 3, includes a plug body 15*a* formed of insulating material such as porcelain, and a center electrode 16 fixed in the center of the plug body 15*a*. The center electrode 16 is composed of a large-diameter shaft portion 16*a* and a small-diameter shaft portion 16*b* each having a predetermined length. Most of the small-diameter shaft portion 16*b* is embedded in the plug body 15*a*. In the substantially central portion of its embedded portion, plural annular projections 17 are formed. A leading end (lower end) 18 of the center electrode 16 is formed acutely. The ignition plug 15 is forced and fixed through a seal material 21 such as an O-ring into an opening 20 provided in the cylinder head 8 in the sealed state as described before. At this time, the leading end 18 of the center electrode 16 is opposed to an earth electrode 23 provided for an extension part 22 of the cylinder head 8.

The above ignition plug 15 uses, for ignition, sparks generated when a high voltage is applied between the center electrode 16 and the earth electrode 23 and aerial discharge occurs. The ignition control of the ignition plug 15, in association with ON-OFF operation of a trigger switch with the operation of a not-shown trigger lever, is performed by supplying the high-voltage electric current from a piezoelectric conductor through an igniter (not-shown) to the electrode. The igniter is electrically connected to a battery.

Next, the lower portion of the center electrode 16 is exposed from the plug body 15*a*. Between its exposed base portion 24 and the leading end 18, a step part 25 is annularly formed. The leading end 18 portion is formed so that its diameter is smaller than the diameter of the exposed base portion 24.

Here, in the above constitution, how a residue P adhering to the center electrode 16 moves to the leading end 18 will be described.

Figure 4A:
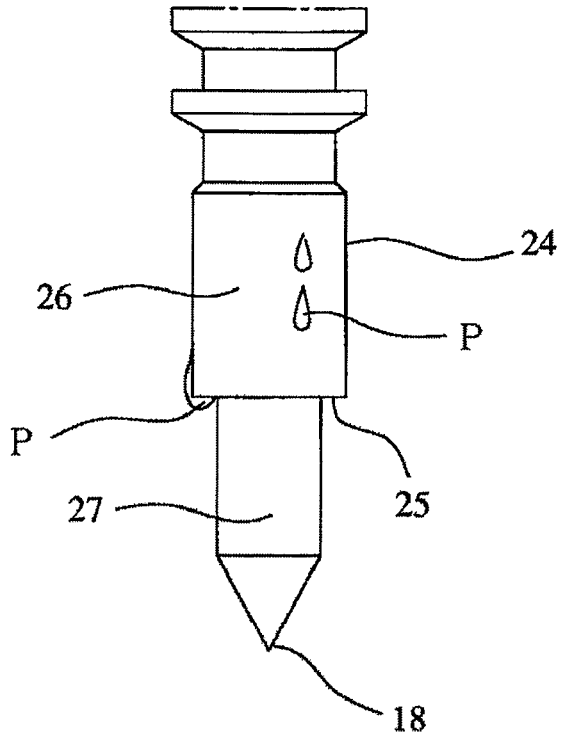
FIG. 4(*a*) is an explanatory view showing a stagnation state of combustion residues onto the above center electrode.
FIG. 4(B) is an explanatory view showing a stagnation state of combustion residues onto the above center electrode.
Figure 4B:
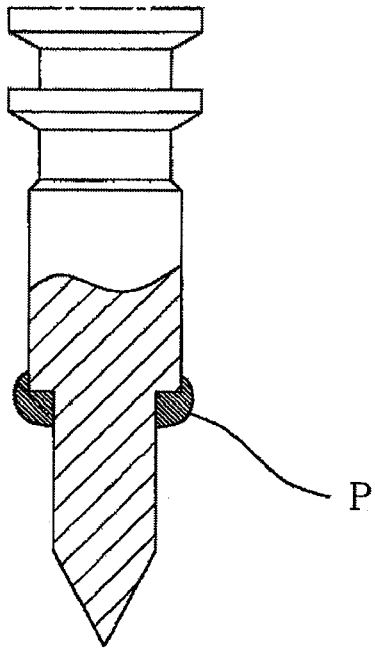

The residue P is gummy fluid that is high in viscosity. When the residue P adheres to the circumferential surface upper portion of a large-diameter portion 26 of the exposed part of the center electrode 16, they move along the circumferential surface of the center electrode 16 toward the leading end 18 of the center electrode 16 little by little. However, as shown in FIG. 4(*a*), when the residue P comes to the step part 25 and then come over the step part 25, they come round on lower surface of the step 25. Since the lower surface of the step part 25 is usually horizontal, the residue P stagnates on the lower surface. The next residue P comes sequentially from the upside little by little, and adhere to the residue P stagnating on the lower surface. Thus, while the residue P is stagnating on the lower surface of the step part 25, it is difficult to move downward, so that the next residue P and the stagnating residue P adhere to each other and grow gradually as shown in FIG. 4(*b*). At this time, between molecules of the residue P, a force of acting so as to make the surface area small, that is, surface tension acts, so that the residue P adheres to the lower surface of the step part 25 in the globular shape and grows. The grown residue P comes to a small-diameter portion 27 of the center electrode 16 before long. However, even when the residue P comes to the small-diameter portion 27, the residue P does not move downward soon along the circumferential surface of the small-diameter portion 27. While bonding between the molecules of the residue P is strong due to the surface tension, the residue P which has come to the small-diameter portion 27 keep bonded integrally to the residue P stagnating on the lower surface of the step part 25. As the residue P grows gradually, a part of the residue P becomes unable to withstand gravity and moves slowly downward along the small-diameter portion. Lastly, the residue P comes to the leading end 18 of the center electrode 16 and stagnates there.

As described above, by forming the step part 25 at the intermediate portion of the exposed portion of the center electrode 16, when the residue P comes here, not only the moving speed of the residue P becomes slow, but also the molecules of the residue P bond to each other and the residue P grows. Also during growing, the residue P stagnates here. In result, the time when the residue P is stagnating at the step part 25 becomes long, so that the time till the residue P moves to the leading end 18 of the center electrode 16 and the leading end 18 is stained with the residue P is delayed.

To the contrary, in case that the outer diameter of the center electrode 16 is the same from the upper portion thereof to the lower portion thereof similarly to the outer diameter of the conventional center electrode, the residue adhering to the circumferential surface thereof moves slowly downward along the circumferential surface as it is. Further, during moving downward, the residue P adheres onto the residue and grows. Therefore, the moving-down speed becomes higher downward.

Further, it is possible to reduce greatly the number of maintenance checks of the ignition plug 15, so that it is possible to reduce the cost on the maintenance.

Figure 5:
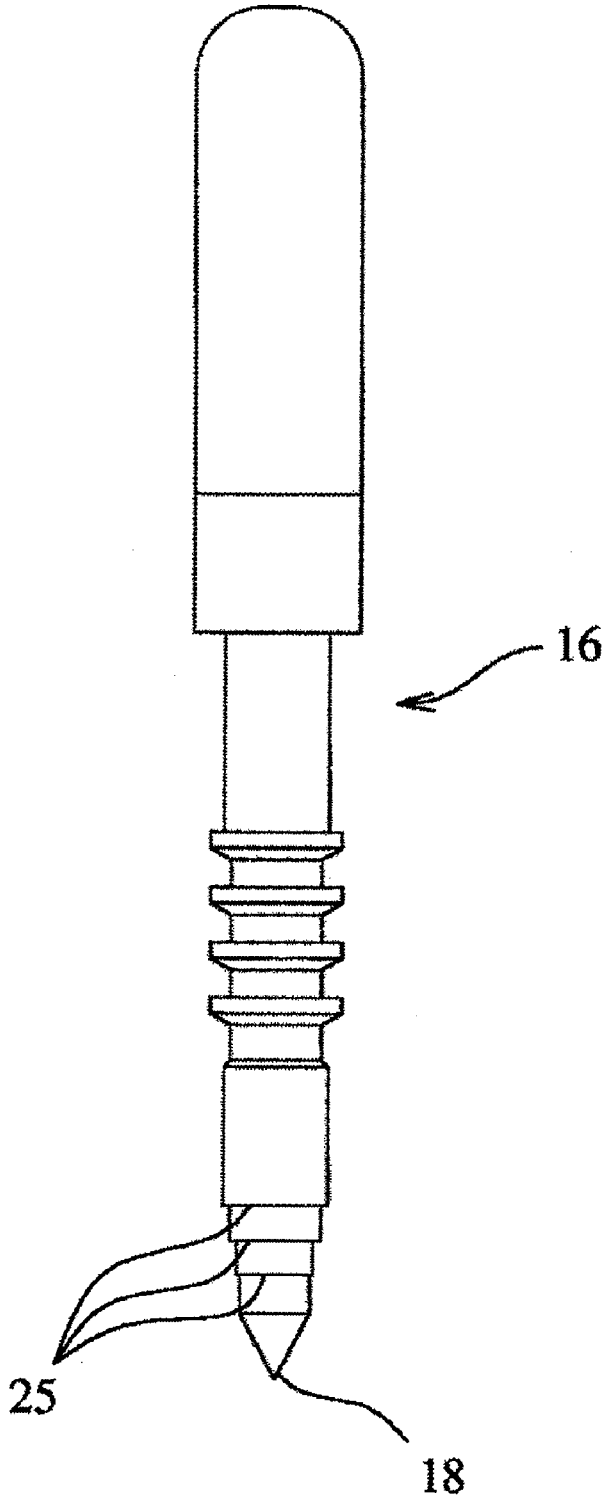
FIG. 5 is a side view showing a center electrode of an ignition plug according to another embodiment.

The number of steps of the step part 25 is not limited to one. As shown in FIG. 5, the step part 25 may be formed in the shape of a multistep. According to this structure, the arrival speed of the gas residue P at the leading end 18 of the center electrode 16 can be delayed more.

Figure 6:
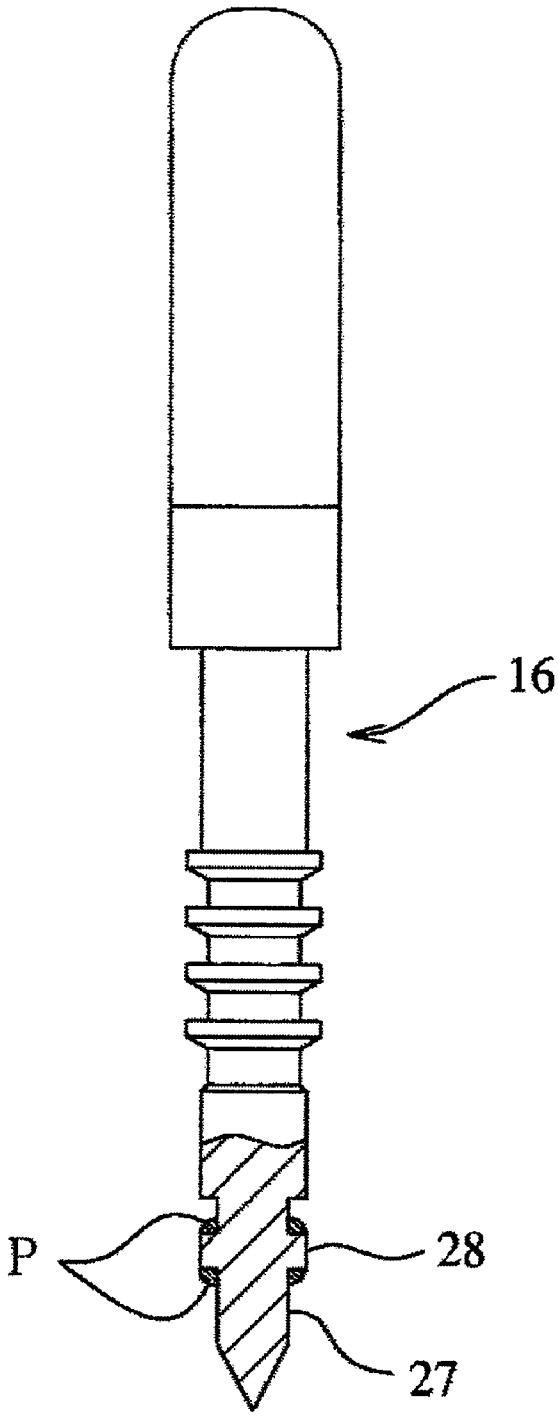
FIG. 6 is a side view showing a center electrode of an ignition plug according to another embodiment.

Further, though the above step part 25 is a stagnation part which stagnates temporarily the residue P produced by the combustion of the above mixture gas, such the stagnation part is not limited to the step part 25. For example, as shown in FIG. 6, at the small-diameter portion 27, an annular protrusion 28 may be formed as the stagnation part. According to this structure, since the above residues P stagnate on the upper and lower surfaces of the annular protrusion 28, the arrival speed at the leading end 18 can be delayed much more greatly.

Figure 7:
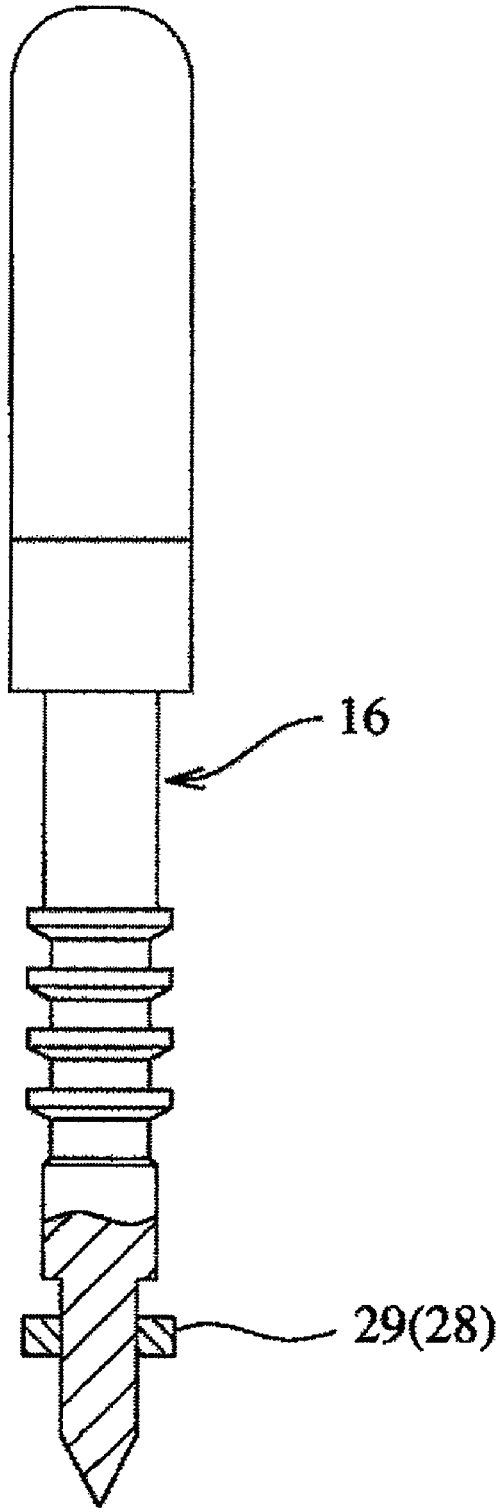
FIG. 7 is a side view showing a center electrode of an ignition plug according to another embodiment.

Further, as shown in FIG. 7, the above annular protrusion 28 may be formed by a ring 29 such as a washer fitted and fixed to the center electrode 16. According to this structure, without directly machining the center electrode 16, the annular protrusion can be readily formed. Further, the exchange of the ring makes the removal work of the residue P unnecessary.

Figure 8:
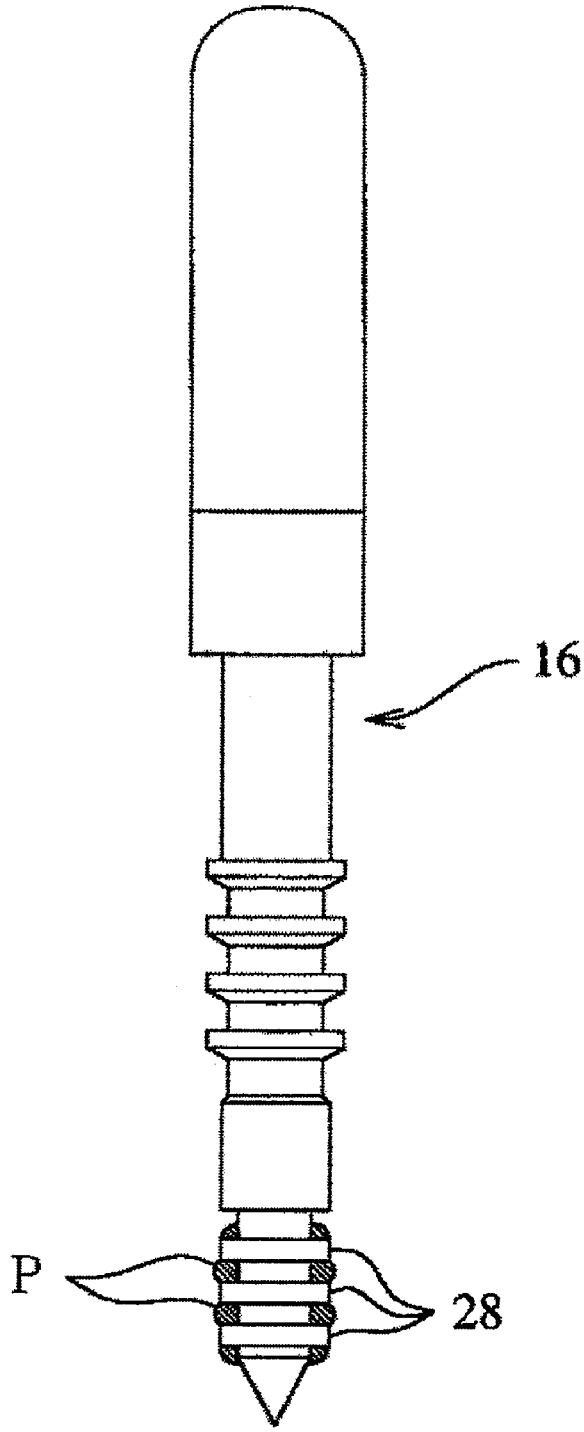
FIG. 8 is a side view showing a center electrode of an ignition plug according to another embodiment.

Further, in case that the annular protrusion 28 is formed in the shape of a multistep as shown in FIG. 8, the stagnation advantage becomes very high.

While the invention has been described in detail and with reference to specific embodiments thereof, it would be apparent to those skilled in the art that various changes and modification may be made therein without departing from the sprit and scope of the invention.

This invention is based on Japanese Patent Application (Application No. 2006-225632), filed on Aug. 22, 2006, the entire contents of which are hereby incorporated by reference.

INDUSTRIAL APPLICABILITY

The invention can be applied to a gas combustion type driving tool in which power is supplied by combustion thereby to drive fasteners such as nails or the like.

The invention claimed is:

1. A gas combustion type driving tool comprising:

a driving cylinder disposed in a tool body;

a driving piston provided in the driving cylinder slidably in an up-down direction;

a movable sleeve provided on an upper part of the driving cylinder;

a cylinder head provided above the driving cylinder;

a combustion chamber which is opened and closed by moving the movable sleeve up and down to bring and separate the movable sleeve into contact with and from the driving cylinder and the cylinder head thereabove;

an ignition plug disposed in the cylinder head; and a plurality of stagnation parts provided between an exposed base portion of a center electrode of the ignition plug which is exposed to the combustion chamber and a leading end of the center electrode, each stagnation part having a diameter greater than a diameter of the leading end, and the most distal stagnation part terminating axially short of the leading end.

2. The gas combustion type driving tool according to claim 1, wherein mixture gas obtained by stirring and mixing combustible gas and air together in the combustion chamber by a fan is ignited by the ignition plug and explosively combusted, the driving piston is driven by this high-pressure combustion gas, and a driver coupled to the lower surface side of the driving piston drives nails; and at least one of the stagnation parts stagnates temporarily a residue remaining after the combustion of the mixture gas.

3. The gas combustion type driving tool according to claim 1, wherein each of the stagnation parts is formed by an annular step part.

4. The gas combustion type driving tool according to claim 1, wherein each of the stagnation parts is formed by an annular protrusion.

5. The gas combustion type driving tool according to claim 4, wherein the annular protrusion is formed by a ring fitted and fixed to the center electrode.

6. An ignition plug of a gas combustion type driving tool comprising:

a center electrode; and a plurality of stagnation parts provided between an exposed base portion of the center electrode and a leading end thereof, wherein each stagnation part is formed by an annular step part or an annular protrusion, each stagnation part having a diameter greater than a diameter of the leading end, and the most distal stagnation part terminating axially short of the leading end.

7. A gas combustion type driving tool comprising:

a driving cylinder disposed in a tool body;

a driving piston provided in the driving cylinder slidably in an up-down direction;

a movable sleeve provided on an upper part of the driving cylinder;

a cylinder head provided above the driving cylinder;

a combustion chamber which is opened and closed by moving the movable sleeve up and down to bring and separate the movable sleeve into contact with and from the driving cylinder and the cylinder head thereabove;

an ignition plug disposed in the cylinder head; and a stagnation part provided between an exposed base portion of a center electrode of the ignition plug which is exposed to the combustion chamber and a leading end of the center electrode, the stagnation part having a diameter greater than a diameter of the leading end, and the stagnation part terminating axially short of the leading end, wherein an upper surface of the stagnation part is exposed to the combustion chamber.

* * * * *